United States Patent [19]

McIntire

[11] Patent Number: 4,671,665

[45] Date of Patent: Jun. 9, 1987

[54] MACHINE FOR MIXING PARTICLES WITH A FLUID COMPOSITION

[75] Inventor: William R. McIntire, Tulsa, Okla.

[73] Assignee: Dowell Schlumberger Incorporated, Tulsa, Okla.

[21] Appl. No.: 861,969

[22] Filed: May 12, 1986

Related U.S. Application Data

[63] Continuation of Ser. No. 714,586, Mar. 21, 1985, Pat. No. 4,614,435.

[51] Int. Cl.[4] ..... B01F 7/16; B28C 5/00

[52] U.S. Cl. ..... 366/40; 55/203; 55/407; 366/65; 366/164; 366/165; 366/263

[58] Field of Search ..... 366/150, 164, 165, 181, 366/263–265, 262, 2, 6, 17, 33, 34, 35, 38, 169, 65, 142, 177, 180, 183, 343, 279, 293, 342, 343, 10, 13, 40, 317, 348, 349; 55/203, 407; 261/87, 93

[56] References Cited

U.S. PATENT DOCUMENTS

| | | | |
|---|---|---|---|
| 2,314,986 | 3/1943 | Johnson | 55/407 |
| 3,147,957 | 9/1964 | Martin | 366/263 |
| 3,201,093 | 8/1965 | Smith | 366/167 |
| 3,326,536 | 6/1967 | Zingg | 366/17 |
| 3,423,075 | 1/1969 | Knudsen | 366/181 |
| 3,994,480 | 11/1976 | Forthergill | 366/165 |
| 4,239,396 | 12/1980 | Arribau | 366/65 |
| 4,336,039 | 6/1982 | Sohre | 55/407 |
| 4,453,829 | 6/1984 | Althouse | 366/40 |

*Primary Examiner*—Robert W. Jenkins
*Attorney, Agent, or Firm*—L. Wayne White

[57] ABSTRACT

The machine disclosed herein is useful for blending a particle containing stream, especially a stream of solid particles, with fluids. In a typical operation, sand is mixed with a gel composition to obtain a fluid mixture suitable for stimulation treatments of oil and gas wells. The machine includes a slinger with a topside surface which may be of toroidal concave configuration. The machine also includes an impeller, of a vortex configuration, that is fastened underneath the slinger. In this machine, entrained gas is carried into the fluid phase by the particle containing stream, but the gas is then "exhausted" from the mixture through interior and exterior air exhaust channels and spaces that are built into the machine. A slinger which is particularly adapted for use in such a machine is also disclosed.

37 Claims, 3 Drawing Figures

MACHINE FOR MIXING PARTICLES WITH A FLUID COMPOSITION

CROSS-REFERENCE TO RELATED APPLICATION

This application is a continuation of pending U.S. patent application Ser. No. 714,586 now U.S. Pat. No. 4,614,435.

BACKGROUND OF THE INVENTION

Broadly, the invention relates to a machine for continuously mixing solid particles with a liquid composition. More specifically, the machine is used as a blender in which sand or sand-like particles are mixed or blended with a gel composition, and the resulting slurry is pressurized by the blender itself. Typically, the slurry is used to treat a well in a petroleum recovery operation.

The blender machine described in U.S. Pat. No. 4,453,829 (Althouse) is typical of conventional blender machines now being used in oil or gas recovery operations. This machine has a slinger element of a toroidal configuration with a concave upper surface. Several upstanding blade members are mounted on the concave surface of this slinger and an impeller member is attached to the underside of the slinger. The slinger and the impeller are enclosed within a housing and fastened to the end of a drive shaft rotated by a motor mounted above the housing. A hopper is mounted above an inlet eye in the top of the housing, for introducing sand or other solid particles into the housing. At the bottom of the housing is a suction eye inlet, for drawing liquid into the housing, and the resulting liquid-solid mixture is discharged through an outlet port in the housing.

In the operation of the blending machine described above, sand flows out of the hopper in a continuous stream and drops onto the rotating slinger through the inlet eye in the housing. With the impeller and slinger rotating at the same speed; the vortex action of the impeller creates a suction force that draws the gel composition into the casing through the suction eye inlet. As the gel is pulled into the casing it is pressurized by the impeller and it mixes thoroughly with the sand being flung outwardly, in a centrifugal action, from the slinger. The sand-gel mixture is then continuously discharged, under pressure, through the outlet port, from which it is carried into a pumper unit and injected into a well.

The Althouse blender has a major drawback that makes it difficult for this machine to thoroughly mix a slurry of a particulate material, such as sand, and a liquid, such as a gel composition. The problem is caused by air in the sand, which becomes entrained in the liquid during the mixing operation. In a typical mixing operation, for example, the slinger and impeller may be rotated at speeds of 1,000 rpm. At these high speeds, the centrifugal action of the slinger causes the sand particles to move outwardly from the slinger into the whirling slurry mass that lies between the slinger-impeller units and the housing and below the impeller.

Centrifugal forces in the whirling slurry set up a radial pressure gradient, and since the density of air is much less than that of the slurry composition, the air is forced toward the center of the slurry mass. Therefore, any air that the sand carries below the upper edge of the slinger can't move outwardly against the pressure gradient and return to the area above the slinger. In other words, once the air moves downwardly from the slinger, it can't reverse its direction and "break out" of the slurry composition through the inlet eye at the top of the housing. Similarly, since the impeller increases in diameter as you move away from the slinger-impeller interface, air can't travel downwardly from the interface toward the underside of the impeller. Since the Althouse blender has no way to exhaust the air, it accumulates at the slinger-impeller interface. Because the slinger is larger in diameter than the impeller, the accumulated air "overflows" from the interface region into the region below the impeller. As a result, some of this air collects below the center of the impeller and forms an "eye". Since the impeller can't pump air, the Althouse blender rapidly loses its suction pressure and it ceases to pump the slurry mixture through the discharge outlet in the housing.

The present invention is based on a modification of the Althouse blender that reduces the air entrainment problem. In the machine of this invention the entrained gas (air) in the mixture can break out of the liquid phase through a gas exhaust means in the slinger and impeller apparatus, and an exhaust gas outlet, that are built into the modified blender structure.

SUMMARY OF THE INVENTION

The blending machine of this invention is designed particularly for mixing particles in a particle containing stream, with a liquid composition. For example, mixing solid particles such as sand, with a liquid composition such as a gel. One element of the foregoing blending machine is a novel slinger. Such slinger is generally circular, and comprises a top side shaped so as to hold back the liquid composition, and preferably create an "eye" therein (i.e., an opening at ambient pressure through which solid particles can be introduced), when the slinger is rotated about its axis in the liquid composition. An underside of the slinger slopes inward and downward at least part way from adjacent the outer periphery of the top side. A gas exhaust means communicates between at least one outlet position adjacent the center of the slinger top side, and at least one inlet position on the slinger underside. Such gas exhaust means is provided to convey gas adjacent each inlet position to an outlet position when the slinger is rotated about its axis in the liquid composition.

The slinger has at least one blade extending upward and radially outward on its top side surface, and preferably has a plurality of such blades. The top side surface of such slinger may usefully be of toroidal concave configuration. The gas exhaust means is preferably a plurality of channels, each of which slopes upward and outward from corresponding inlet to outlet positions.

The slinger may be a component of a slinger and impeller apparatus, which includes a generally circular impeller attached to an underside of the slinger. Such impeller is provided with an underside shaped so as to produce a vortex below and adjacent to it, when it is rotated about its axis in the liquid composition. Preferably, the impeller is connected to the slinger to rotate synchronously with it. The apparatus further includes an outer side which is defined by at least a portion of the underside of the slinger, and at least a portion of the top side of the impeller. The outer side slopes inward and downward at least part way from adjacent the outer periphery of the slinger top side. Preferably, the outer side slopes inward and downward to an innermost portion of it, then slopes outward and downward from such innermost portion to adjacent the underside of the impeller. In such case, the inlet position of the gas exhaust means is disposed at the innermost portion of the outer side. In one embodiment, the slinger and impeller are actually spaced apart to define a first portion of the gas exhaust means, which includes each inlet portion. In such case, the outer side slopes inward and downward on the slinger and slopes outward and downward on the impeller.

The slinger and impeller apparatus may form an element in a machine of the present invention which is useful for mixing particles in a particle containing stream, with a liquid composition. Such machine includes a housing having a liquid composition inlet, and a mixture outlet. The housing also has a stream inlet and an exhaust gas outlet disposed on an upper side of the housing. The slinger and impeller apparatus of the type described, is in such case rotatably mounted within the housing, with the slinger extending beneath the stream inlet and exhaust gas outlet. The foregoing arrangement is such that during mixing of the liquid composition and the stream, gas entrained within the mixture can be carried out of the mixture through the gas exhaust means of the slinger and impeller apparatus, and the housing exhaust gas outlet.

During the mixing operation the particles carry a gas (air) into the liquid composition and this gas becomes entrained in the liquid phase of the liquid/particle mixture. The entrained gas is carried out of the mixture through the air exhaust means, the interior air exhaust channel, and the exhaust gas outlet.

DESCRIPTION OF THE INVENTION

Figure 1:
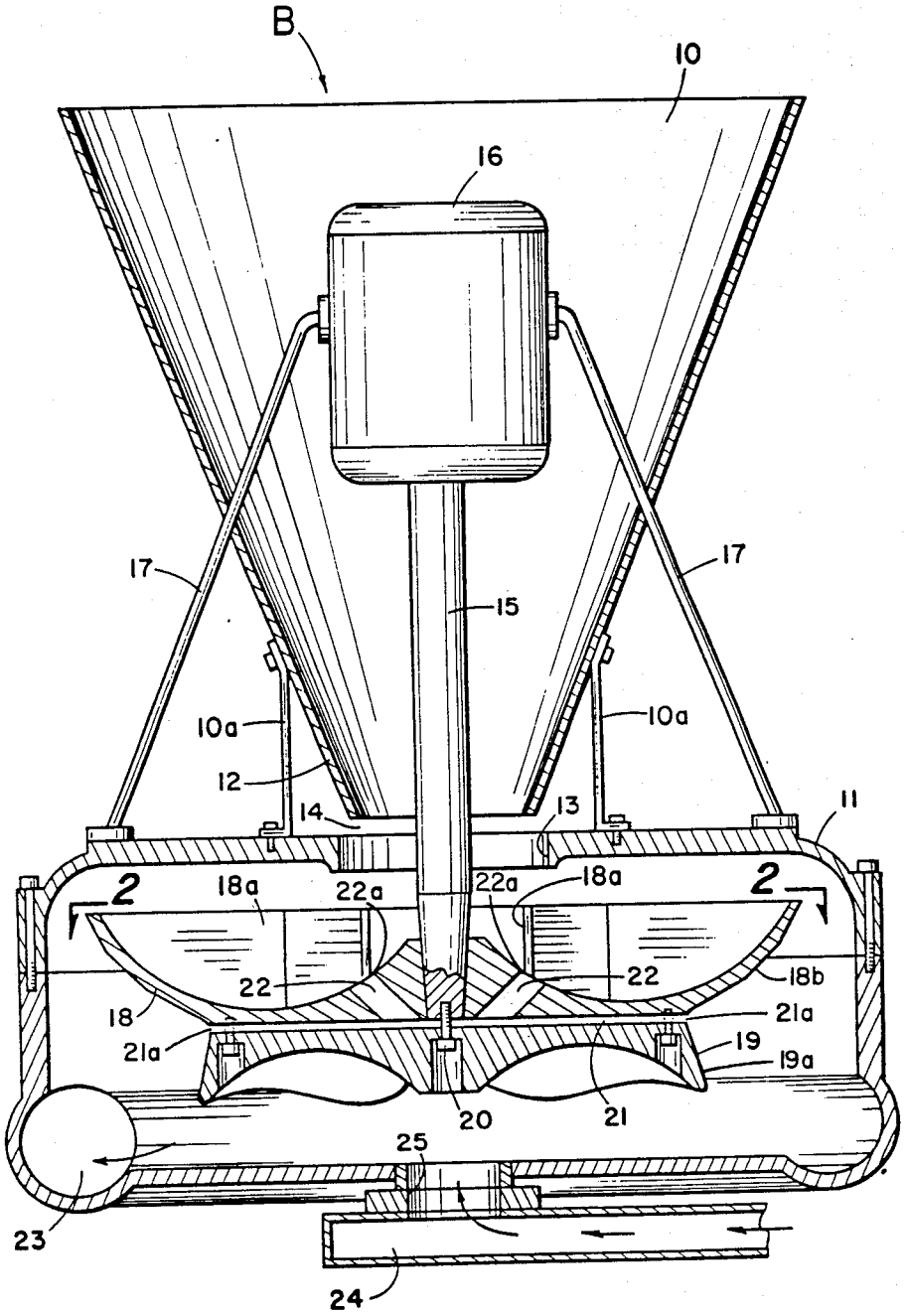
FIG. 1 is a front elevation view, mostly in section, of one embodiment of the blender machine of this invention.
Figure 2:
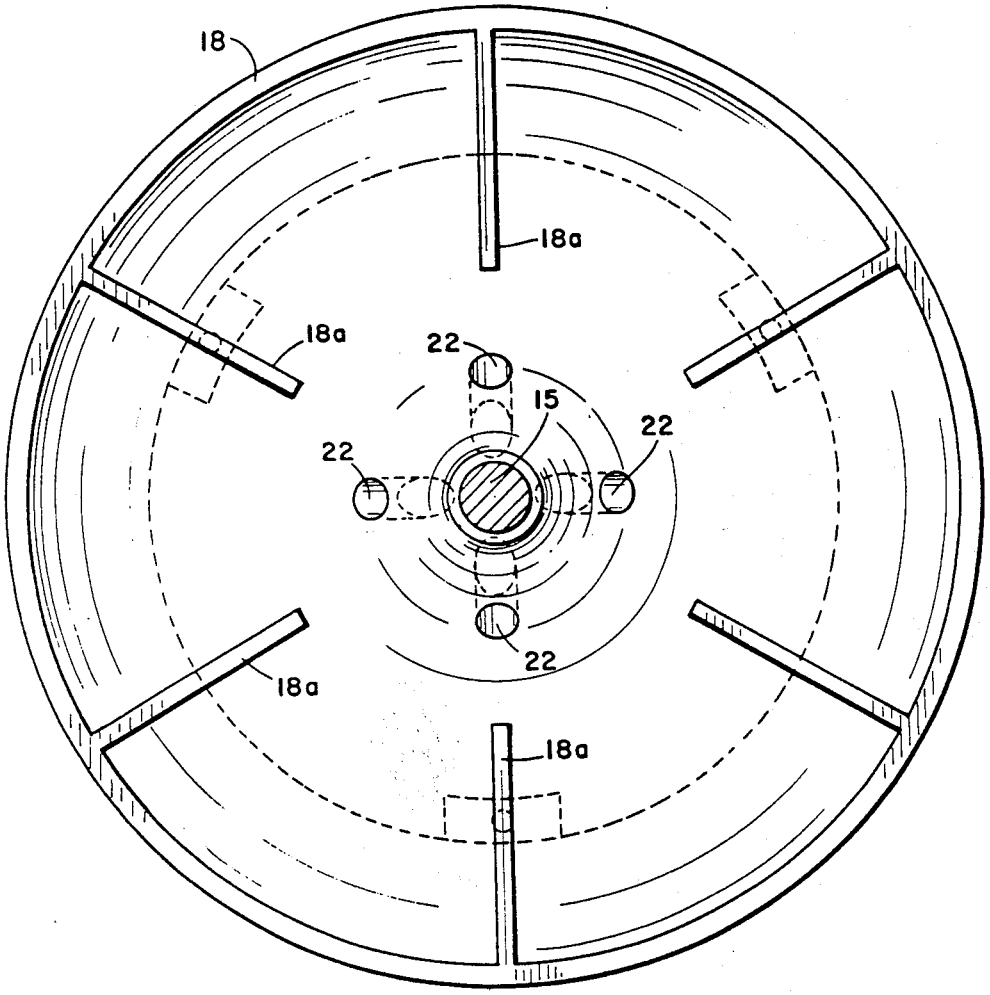
FIG. 2 is a plan view of the slinger component of the blender machine, as taken on line 2—2.

One embodiment of the blender machine of this invention is illustrated in FIG. 1. In FIG. 1 the blender machine is generally indicated by the letter B. At the top of the blender is a hopper 10 that provides a container for solid particles, such as sand (not shown). In this embodiment the hopper 10 is mounted on the top side of a housing 11 and held in place by supports 10*a*. As illustrated, the bottom end of the hopper, which is the outlet end 12, terminates just above inlet eye 13 in housing 11. Sand or other solids from the hopper are dropped into the housing through the inlet eye. Hopper 10 then, acts as a stream conduit to conduct a stream of the particles through inlet eye 13 into housing 11, while inlet eye 13 acts as a stream inlet. Positioning the outlet end 12 just above the inlet eye 13 provides an exterior air exhaust space 14 between the hopper and the inlet eye.

A drive shaft 15 is positioned inside the hopper 10, such that the bottom of the shaft extends through the inlet eye 13 and into housing 11. The shaft is driven by a motor 16 at the top end of the shaft, the motor and shaft together acting as a drive means. The motor is supported by rods 17 that are fastened into the housing 11. The mixer elements of the blender machine consist of a slinger 18 and an impeller 19. The impeller is secured to the bottom end of drive shaft 15 by a bolt fastener 20. Slinger 18 is fastened to impeller 19 to rotate synchronously therewith, and is axially spaced apart therefrom (as best shown in FIG. 1), to define an interior gas exhaust space 21, between the underside of the slinger and the topside of the impeller. Exhaust space 21 acts as a first portion of a gas exhaust means, the remainder of which means will be described shortly. Outer periphery positions 21*a* of space 21 act as inlet positions of such gas exhaust means.

Slinger 18 has a central opening therein (not shown) that allows it to fit over the bottom end of the drive shaft 15 above the bolt fastener 20. The slinger has a topside surface of toroidal concave configuration which faces toward the top of the housing 11. The slinger also includes some exhaust channels 22 that extend diagonally through the body of the slinger. One end of each channel communicates with the interior exhaust space 21, and the opposite end defines an opening along the concave surface of the slinger. Channels 22 act as the remainder of the gas exhaust means already mentioned with openings 22*a* of channels 22 being outlet positions of such gas exhaust means. The impeller has a vortex configuration with a concave surface which faces toward the bottom of the housing. When impeller 19 is rotated about its axis in the liquid composition then, the underside of it will produce a vortex adjacent thereto.

An outer side of the slinger 18 and impeller 19 apparatus, is defined by inward and downward sloping portion 18*b* of the slinger underside, together with outward and downward sloping portion 19*a* of the impeller topside. Such outer side then, slopes inward and downward from adjacent the outer periphery of slinger 18, to an innermost portion, then slopes outward and downward to adjacent the underside of impeller 19. It will be seen particularly clearly from FIG. 1, that inlet positions 21*a* are disposed at an innermost portion of such outer side of the slinger 18 and impeller 19 apparatus.

In the embodiment illustrated in FIG. 1, the topside concave surface of slinger 18 is interrupted by several upstanding, radially outwardly extending, blade members 18*a*. Housing 11 encloses the slinger 18 and impeller 18*a*, and the housing includes a mixture outlet 23, for discharging material from the housing. One end of an inlet conduit 24 is connected into the housing 11 and the opposite end of the conduit is connected into a source for a liquid composition, such as a gel. During the mixing operation the liquid composition is drawn into the housing 11 through the inlet conduit 24 and a suction-eye inlet 25 at the bottom of the housing 11 (which may be referred to as a liquid composition inlet).

Operation

In a typical operation of the blender machine of this invention, sand is mixed with a gel composition to obtain a liquid mixture suitable for injecting into an earth fracture to stimulate recovery of oil or gas. At the start of the mixing operation, the motor 16 rotates the drive shaft 15, slinger 18, and impeller 19. With the slinger and impeller in motion, a desired amount of sand is dropped into hopper 10 so that it flows in a continuous stream through the inlet eye 13 and drops onto the rotating slinger 19. As the sand drops onto the slinger, it is propelled outwardly into the housing 11. With the vortex impeller rotating at the same speed as the slinger, the vortex action of the impeller creates a suction force inside the housing, and this force pulls the gel composition into the housing through the suction-eye inlet 25.

As the gel is pulled into the housing 11, it is pressurized by the impeller and it interfaces with the sand being flung outwardly from slinger 18. The result is a thorough mixing of the solid-gel composition, which is continuously discharged under pressure through the outlet 23. From outlet 23 the sand-gel mixture is carried into a pumper unit for injection into a wellhead and down the borehole. The pumper unit, the wellhead, and the borehole are not illustrated in the drawing.

As described earlier, air trapped in the sand particles is carried into the liquid phase during the mixing operation. But, in the practice of this invention the interior exhaust space 21, and the interior exhaust channels 22, along with the exterior exhaust space 14, allow the air to escape from the liquid phase, rather than becoming entrained in the liquid. Such escaping air must of course pass through inlet eye 13, which therefore acts as both a stream inlet, as described earlier, and an exhaust gas outlet.

Figure 3:
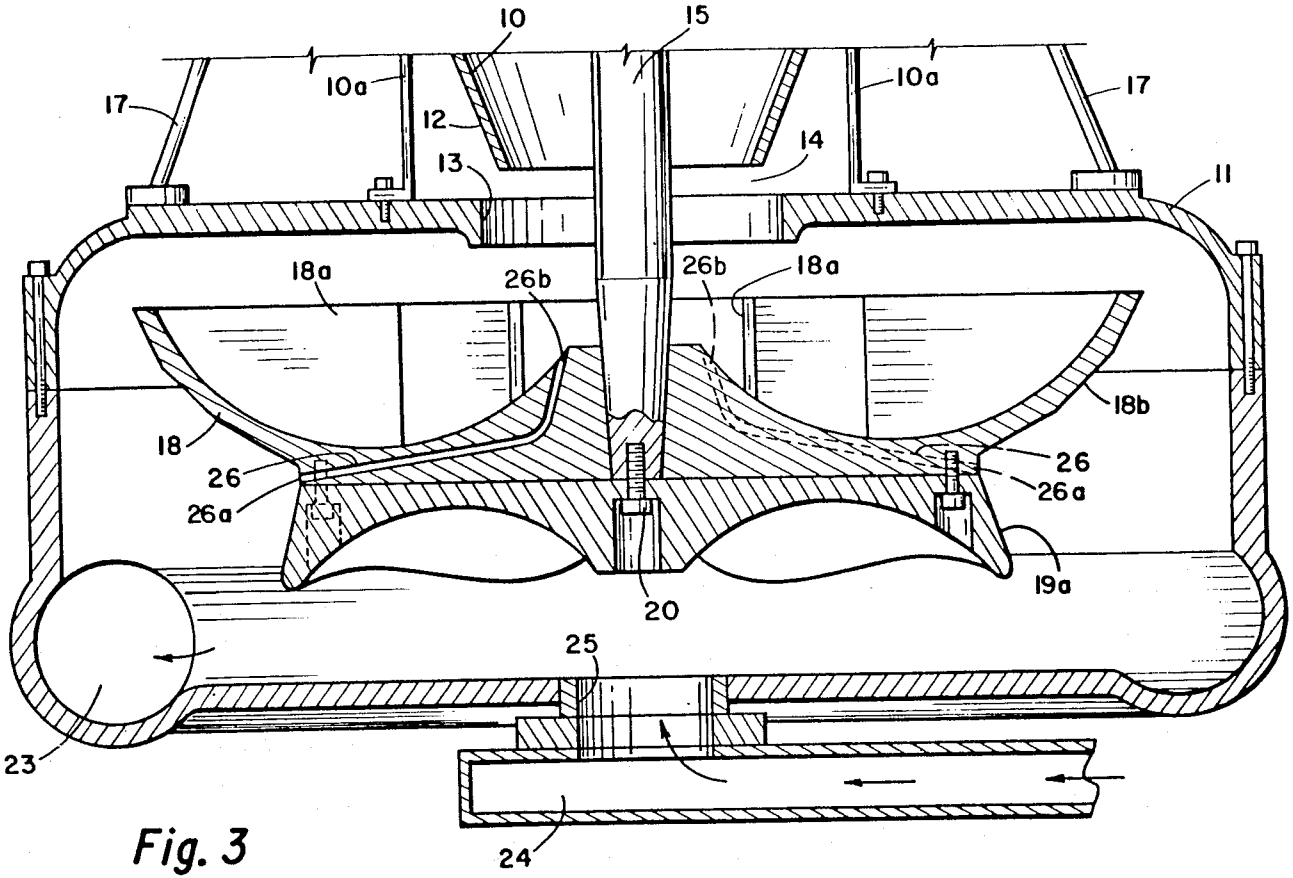
FIG. 3 is a partial front elevation view, mostly in section, of the second embodiment of the blender machine of this invention.

Looking now at FIG. 3, this embodiment of the blender machine is identical to that shown in FIG. 1, except for the gas exhaust means that is built into this structure. In FIGS. 1 and 3, therefore, the same reference numerals are used to identify the same parts in each of these blender structures. In the structure illustrated in FIG. 3 the gas exhaust means is provided by one or more exhaust channels 26. The lower end **26*a* of each channel 26 is located on the periphery of the slinger 18 near the juncture of the slinger and impeller 19 (the innermost portion of the outer side of the slinger and impeller apparatus). The opposite, or upper end 26*b* of each channel is located on the topside concave surface of the impeller near the center of the surface. Lower ends 26*a* then act as gas inlets of the gas exhaust means, while upper ends 26*b* act as gas outlets thereof. In operation, therefore, the air that is carried into the liquid phase by the sand is carried upwardly through the channels 26 and is "exhausted" through the inlet eye 13 and the exterior air exhaust space 14. In the practice of this invention, one air exhaust channel 26** may be used, but better results are obtained by providing two or more of these channels in the blender structure.

Since the blender machine of this invention is a modification of the Althouse blender, as described in U.S. Pat. No. 4,453,829, the general teachings of that patent are incorporated by reference into the present specification.

I claim:

1. A generally circular slinger useful for a machine which can mix particles in a particle-containing stream with a liquid composition, comprising:

(a) a topside shaped so as to hold back the liquid composition above and adjacent the topside, when the slinger is rotated about its axis in the liquid composition;

(b) an underside which slopes inward and downward at least part way from adjacent the outer periphery of the topside;

(c) a gas exhaust means communicating between at least one outlet position adjacent the center of the slinger topside, and at least one inlet position on the slinger underside, for conveying gas adjacent each inlet position to an outlet position when the slinger is rotated about its axis in the liquid composition.

2. A slinger as defined in claim 1 wherein the gas exhaust means comprises at least one channel which slopes upward and outward from corresponding outlet to inlet positions.

3. A generally circular slinger useful for a machine which can mix particles in a particle-containing stream with a liquid composition, comprising:

(a) a topside shaped so as to hold back the liquid composition and create an eye therein above and adjacent the topside, when the slinger is rotated about its axis in the liquid composition;

(b) an underside which slopes inward and downward at least part way from adjacent the outer periphery of the topside;

(c) a gas exhaust means communicating between at least one outlet position adjacent the center of the slinger topside, and at least one inlet position on the slinger underside, for conveying gas adjacent each inlet position to an outlet position when the slinger is rotated about its axis in the liquid composition.

4. A slinger as defined in claim 3, wherein the slinger topside has a topside surface and at least one blade extending upward and radially outward thereon.

5. A slinger as defined in claim 4, wherein the topside surface is of toroidal concave configuration.

6. A slinger as defined in claim 5 wherein the slinger topside has a plurality of blades extending upward and outward on the topside surface.

7. A slinger as described in claim 5 wherein the gas exhaust means comprises a plurality of channels, each of which slopes upward and outward from corresponding inlet to outlet positions.

8. A slinger as described in claim 3 wherein the gas exhaust means comprises a plurality of channels, each of which slopes upward and outward from corresponding inlet to outlet positions.

9. A slinger and impeller apparatus useful for a machine which can mix particles in a particle-containing stream with a liquid composition comprising:

(a) a generally circular slinger having a topside shaped so as to hold back the liquid composition above and adjacent the topside, when the slinger is rotated about its axis in the liquid composition;

(b) a generally circular impeller connected to an underside surface of the slinger, and having an underside shaped so as to produce a vortex below and adjacent thereto, when the impeller is rotated about its axis in the liquid composition;

(c) an outer side defined by at least a portion of the underside of the slinger and at least a portion of the topside of the impeller, which outer side slopes inward and downward at least part way from adjacent the outer periphery of the slinger topside; and (d) a gas exhaust means communicating between at least one outlet position adjacent the center of the slinger topside, and at least one inlet position on the outer side, for conveying gas adjacent each inlet position to an outlet position when the slinger and impeller are rotated about their axes in the liquid composition.

10. An apparatus as defined in claim 9 wherein the slinger diameter is greater than the impeller diameter, and the impeller is connected to the slinger to rotate synchronously therewith, the outer side first slopes inward and downward from adjacent the outer periphery of the slinger topside to an innermost portion of the outer side, then slopes outward and downward from the innermost portion to adjacent the underside of the impeller, and wherein each inlet position of the gas exhaust means is disposed at the innermost portion of the outer side.

11. A slinger and impeller apparatus useful for a machine which can mix particles in a particle-containing stream with a liquid composition comprising:

(a) a generally circular slinger having a topside shaped so as to hold back the liquid composition and create an eye therein above and adjacent the topside, when the slinger is rotated about its axis in the liquid composition;

(b) a generally circular impeller connected to an underside surface of the slinger, and having an underside shaped so as to produce a vortex below and adjacent thereto, when the impeller is rotated about its axis in the liquid composition;

(c) an outer side defined by at least a portion of the underside of the slinger and at least a portion of the topside of the impeller, which outer side slopes inward and downward at least part way from adjacent the outer periphery of the slinger topside; and (d) a gas exhaust means communicating between at least one outlet position adjacent the center of the slinger topside, and at least one inlet position on the outer side, for conveying gas adjacent each inlet position to an outlet position when the slinger and impeller are rotated about their axes in the liquid composition.

12. An apparatus as defined in claim 11 wherein the slinger diameter is greater than the impeller diameter, and the impeller is connected to the slinger to rotate synchronously therewith.

13. An apparatus as defined in claim 12 wherein the outer side first slopes inward and downward from adjacent the outer periphery of the slinger topside to an innermost portion of the outer side, then slopes outward and downward from the innermost portion to adjacent the underside of the impeller, and wherein each inlet position of the gas exhaust means is disposed at the innermost portion of the outer side.

14. An apparatus as defined in claim 13, wherein the slinger topside has a topside surface and at least one blade extending upward and radially outward thereon.

15. An apparatus as defined in claim 14, wherein the topside surface is of toroidal concave configuration.

16. An apparatus as defined in claim 15, wherein the slinger topside has a plurality of blades extending upward and outward on the topside surface.

17. An apparatus as defined in claim 16, wherein the outer side slopes inward and downward on the slinger, then slopes outward and downward on the impeller, and wherein the slinger and impeller are axially spaced apart to define a first portion of the gas exhaust means, including each inlet portion.

18. An apparatus as defined in claim 17, wherein the gas exhaust means additionally comprises a plurality of channels in the slinger, each of which slopes upward and outward from the first portion of the gas exhaust means, to a corresponding outlet position.

19. A machine as defined in claim 17, wherein the liquid composition inlet is disposed on a lower side of the housing and beneath the center of the impeller, and wherein the exhaust gas outlet is disposed above the center of the slinger.

20. A machine as defined in claim 19, wherein the apparatus is disposed in a laterally central position within the housing, and wherein the housing exhaust gas outlet and liquid composition inlet are axially aligned with the apparatus.

21. A machine as defined in claim 20, wherein the housing has an inlet eye in the upper side, which defines the stream inlet and the exhaust gas outlet.

22. A machine as defined in claim 21, additionally comprising a stream conduit having an outlet disposed directly above the inlet eye so as to define an exterior gas exhaust space between the stream conduit outlet and the inlet eye.

23. A machine as defined in claim 21, wherein the outer side of the apparatus slopes inward and downward from adjacent the outer periphery of the slinger topside to an innermost portion of the outer side, then slopes outward and downward from the innermost position to adjacent the underside of the impeller, and wherein each inlet portion of the gas exhaust means is disposed adjacent the innermost portion of the outer side.

24. A machine as defined in claim 23, wherein the slinger topside has a topside surface and at least one blade extending upward and radially outward thereon.

25. A machine as defined in claim 23, wherein the topside surface of the slinger is of toroidal concave configuration.

26. A machine as defined in claim 25 wherein the slinger topside has a plurality of blades extending upward and radially outward on the topside surface.

27. A machine as defined in claim 26, wherein the outer side of the apparatus slopes inward and downward on the slinger, then slopes outward and downward on the impeller, and wherein the slinger and impeller are axially spaced apart to define a first portion of the gas exhaust means, including each inlet portion.

28. A machine as defined in claim 26, wherein the gas exhaust means additionally comprises a plurality of channels in the slinger, each of which slopes upward and outward from the first portion of the air exhaust means, to a corresponding outlet position.

29. A machine as defined in claim 20, additionally comprising a stream conduit having an outlet disposed to provide the particle containing stream through the housing stream inlet into the housing.

30. A machine as defined in claim 19, wherein an inside surface of each of the upper and lower side of the housing is substantially flat, and wherein the linear distance between an upper edge of each blade and the nearest opposite point on the inside surface of the upper side of the housing, defines a positive gap between the slinger and the housing which is in the range of about one-half to about twice the depth of each blade, the depth of each blade being defined as the linear distance from an upper edge to the lowest point of the blade.

31. A machine which can mix particles in a particle containing stream, with a liquid composition, which includes means for exhausting entrained gas from the mixture, the machine comprising:

(a) a housing having:

(i) a liquid composition inlet;

(ii) a mixture outlet;

(iii) a stream inlet disposed on an upper side of the housing;

(iv) an exhaust gas outlet disposed on an upper side of the housing;

(b) a slinger and impeller apparatus having:

(i) a generally circular slinger having a topside shaped so as to hold back the liquid composition above, and adjacent the topside, when the slinger is rotated about its axis in the liquid composition;

(ii) a generally circular impeller connected to an underside of the slinger, and having an underside shaped so as to produce a vortex adjacent thereto, when the impeller is rotated about its axis in the liquid composition, the impeller having a diameter less than the slinger and being connected thereto to rotate synchronously therewith;

(iii) an outer side defined by at least a portion of the underside of the slinger and at least a portion of the topside of the impeller, which outer side slopes inward and downward at least part way from adjacent the outer periphery of the slinger topside; and (iv) a gas exhaust means communicating between at least one outlet position adjacent the center of the slinger topside, and at least one inlet position on the outer side, for conveying gas adjacent each inlet position to an outlet position, when the slinger and impeller are rotated about their axes in the liquid composition; the apparatus being rotatably mounted within the housing with the slinger extending beneath the stream inlet and exhaust gas outlet, so that during mixing of the liquid composition and the stream, gas entrained within the mixture can be carried out of the mixture through the gas exhaust means of the apparatus and the housing exhaust gas outlet.

32. A machine which can mix particles in a particle containing stream, with a liquid composition, which includes means for exhausting entrained gas from the mixture, the machine comprising:

(a) a housing having:

(i) a liquid composition inlet;

(ii) a mixture outlet;

(iii) a stream inlet disposed on an upper side of the housing;

(iv) an exhaust gas outlet disposed on an upper side of the housing;

(b) a slinger and impeller apparatus having:

(i) a generally circular slinger having a topside shaped so as to hold back the liquid composition and create an eye therein above, and adjacent the topside, when the slinger is rotated about its axis in the liquid composition;

(ii) a generally circular impeller connected to an underside of the slinger, and having an underside shaped so as to produce a vortex adjacent thereto, when the impeller is rotated about its axis in the liquid composition, the impeller having a diameter less than the slinger and being connected thereto to rotate synchronously therewith;

(iii) an outer side defined by at least a portion of the underside of the slinger and at least a portion of the topside of the impeller, which outer side slopes inward and downward at least part way from adjacent the outer periphery of the slinger topside; and (iv) a gas exhaust means communicating between at least one outlet position adjacent the center of the slinger topside, and at least one inlet position on the outer side, for conveying gas adjacent each inlet position to an outlet position, when the slinger and impeller are rotated about their axes in the liquid composition; the apparatus being rotatably mounted within the housing with the slinger extending beneath the stream inlet and exhaust gas outlet, so that during mixing of the liquid composition and the stream, gas entrained within the mixture can be carried out of the mixture through the gas exhaust means of the apparatus and the housing exhaust gas outlet.

33. A machine which can mix particles in a particle containing stream with a liquid composition, which includes means for exhausting entrained gas from the mixture, the machine comprising:

(a) a housing member having (i) an inlet eye in an upper side, which defines a stream inlet and an exhaust gas outlet;

(ii) a liquid composition inlet disposed in a lower side of the housing and axially aligned with the inlet eye; and (iii) a mixture outlet;

(b) a generally circular slinger and impeller apparatus axially aligned with the inlet eye and liquid composition inlet, comprising:

(i) a circular slinger having a topside shaped so as to hold back the liquid composition and create an eye therein above and adjacent the topside when the slinger is rotated about its axis in the liquid composition, the topside including a topside surface and a plurality of blades extending upward and radially outward thereon;

(ii) a circular impeller of diameter less than the slinger connected to an underside of the slinger to rotate synchronously therewith, the impeller having an underside shaped so as to produce a vortex adjacent thereto when the impeller is rotated about its axis in the liquid composition;

(iii) an outer side defined by a portion of the underside of the slinger and a portion of the topside of the impeller, which outer side slopes inward and downward part way from adjacent the outer periphery of the slinger topside to an innermost portion of the outer side, then slopes outward and downward to adjacent the underside of the impeller;

(iv) a gas exhaust means communicating between at least one outlet position adjacent the center of the slinger topside and at least one inlet position each of which is disposed at the innermost portion of the outer side, for conveying gas adjacent each inlet position to an outlet position when the slinger and impeller are rotated about their axes in the liquid composition to mix the particles in the stream with the liquid composition;

(c) a drive means connected to the slinger and impeller apparatus for rotating the slinger and impeller.

34. A machine as defined in claim 33 wherein the drive means comprises:

(a) a drive shaft that extends into the housing through the inlet eye, and is connected to the slinger; and (b) a motor connected to the drive shaft to rotate the drive shaft, the slinger, and the impeller.

35. A machine as fined in claim 33 wherein the slinger and impeller are axially spaced apart to define a first portion of the gas exhaust means, including each inlet position, and wherein the outer side of the apparatus slopes inward and downward on the slinger, then slopes outward and downward on the impeller.

36. A machine as defined in claim 33, wherein an inside surface of each of the upper and lower side of the housing is substantially flat, and wherein the linear distance between an upper edge of each blade and the nearest opposite point on the inside surface of the upper side of the housing defines a positive gap between the slinger and the housing, which is in the range of about one-half to about twice the depth of each blade, the depth of each blade being defined as the linear distance from an upper edge to the lowest point of the blade.

37. A machine as defined in claim 33, having a stream conduit in the form of a hopper, which hopper has an outlet disposed directly above the inlet eye and spaced apart therefrom to define an exterior gas exhaust space between the stream conduit outlet and the inlet eye.

* * * * *